BEST AVAILABLE COF

United States Patent [19]
Nishiki et al.

[11] Patent Number: 4,900,419
[45] Date of Patent: Feb. 13, 1990

[54] CATHODE FOR ELECTROLYSIS AND PROCESS FOR PRODUCING THE SAME

[75] Inventors: Yoshinori Nishiki; Shuji Nakamatsu, both of Kanagawa; Takayuki Shimamune, Tokyo, all of Japan

[73] Assignee: Permelec Electrode Ltd., Kanagawa, Japan

[21] Appl. No.: 213,047

[22] Filed: Jun. 29, 1988

[30] Foreign Application Priority Data

Jun. 29, 1987 [JP] Japan ..... 62-159685
Jul. 17, 1987 [JP] Japan ..... 62-177086

[51] Int. Cl.[4] ..... C25B 11/04
[52] U.S. Cl. ..... 204/290 R; 204/291
[58] Field of Search ..... 204/290 R, 290 F, 291, 204/40, 44.6, 47, 43.1, 45.1; 427/125, 126.5, 229, 304

[56] References Cited

U.S. PATENT DOCUMENTS 4,238,311 12/1980 Haynes ..... 204/290 R
4,248,906 2/1981 Saoto et al. ..... 427/229
4,465,654 8/1984 Faschingbauer ..... 423/245
4,552,787 11/1985 Chebiniar et al. ..... 427/304

FOREIGN PATENT DOCUMENTS 0129734 1/1985 European Pat. Off. .
0209427 12/1986 European Pat. Off. .
2074190 10/1981 United Kingdom .

*Primary Examiner*—John F. Niebling
*Assistant Examiner*—Kathryn Gorgos
*Attorney, Agent, or Firm*—Sughrue, Mion, Zinn, Macpeak & Seas

[57] ABSTRACT

A cathode for electrolysis, particularly of a sodium chloride aqueous solution by an ion-exchange membrane method, and a process for producing the same, the cathode comprising a conductive base having a nickel surface and having provided thereon (a) at least one platinum group component selected from the group consisting of a platinum group metal, a platinum group metal oxide, and a platinum group metal hydroxide, and (b) at least one cerium component selected from the group consisting of cerium, cerium oxide, and cerium hydroxide, retaining a markedly reduced hydrogen overpotential for an extended period of time and exhibiting excellent resistance to impurities in the electrolytic solution.

10 Claims, No Drawings

BEST AVAILABLE COF

PENCIL ERASER ASSEMBLY

BACKGROUND OF THE INVENTION

1. Technical Field

This invention relates to a pencil eraser assembly for attachment to the writing end of a pencil, and more particularly to a sleeved eraser which protrudes from the sleeve at a point adjacent to the pencil lead.

2. Background Art

Both mechanical and conventional wood pencils have, for many years, been adapted to provide an attached eraser at the end of the cylindrical pencil barrel opposite from which the pencil lead extends out. Conventional wood pencils typically are provided with a non-renewable and non-adjustable eraser attached by means of a cylindrical band and sized such that the exhaustion of the usable portion of the eraser will coincide with the life of the pencil as it is used and resharpened.

Mechanical pencils, on the other hand, have a virtually unlimited life by virtue of replacement pencil leads. As a result mechanical pencils are usually provided with some sort of adjustable eraser mechanism and replaceable erasers. Examples of these eraser adjustment mechanisms can be found in U.S. Pat. Nos. 1,671,393; 3,072,101; 3,099,251; 3,203,401; and 4,352,580. Each of the above listed U.S. Patents provide a unique type of adjustment mechanism to facilitate extension of additional portions of an elongated eraser as it is consumed in normal use.

However, in all cases the eraser is located at the end of the pencil opposite that from which the lead extends. Thus, when the user desires to erase pencil writing, the pencil must be turned over to utilizer the eraser. None provide for an eraser in conical elemental alignment with the frustum segment of the pencil barrel assembly. If the eraser was located adjacent to the pencil lead it would eliminate the need to turn the pencil over in order to erase writing, and instead provide for a simple rotation of the pencil assembly about its barrel axis to properly position the eraser on the writing surface.

Accordingly, it is an object of this invention to provide an adjustable eraser assembly for attachment to a pencil wherein the usable portion of the eraser is adjacent to the extended pencil lead.

It is another object of this invention to provide for a pencil eraser assembly which is adapted for attachment to a mechanical pencil or a conventional wood pencil. A third object is to provide an adjustable pencil eraser assembly which is inexpensive and simple to manufacture.

DISCLOSURE OF INVENTION

These objects are accomplished by an adjustable eraser assembly having an elongated sleeve formed to align, in parallel spaced relationship, with the cylindrical segment of the pencil barrel assembly and to further extend along elementally parallel to the frustum segment of the pencil barrel to a point adjacent to the end point of the frustum or conical segment. An elongated eraser plug is slidably retained within said sleeve, and adjustably extending out therefrom adjacent to the pencil lead.

A piston having a push tab attached thereto is slidably mounted within the sleeve with the push tab extending out through a longitudinal slot in the sleeve, and is attached to the end of the eraser to provide a means for sliding the eraser out in an extended position to erase and for retracting it when not in use.

Two primary embodiments are provided, the first where the eraser plug frictionally engages the interior surface of the sleeve, and the second where a ratchet pawl is attached to the piston by means of a contilevered arm and sequentially engages a plurality of ratchet notches formed integral with the elongated slot of the eraser sleeve.

An attachment bracket or band is formed integral with the sleeve for frictionally engaging the cylindrical segment of the pencil barrel to hold the eraser assembly in place.

BRIEF DESCRIPTION OF THE DRAWINGS

FIG. 1 is a sectional side view of the eraser assembly attached to a mechanical pencil.

FIG. 2 is a perspective representational view of the first embodiment of the eraser assembly.

FIG. 3 is a sectional side view of a second embodiment of the eraser assembly having a ratchet pawl attached to the piston.

FIG. 4 is a representational perspective view of the piston and ratchet pawl assembly.

FIG. 5 is a top plan view of the second embodiment showing the notched slot, ratchet pawl assembly, and eraser plug.

BEST MODE FOR CARRYING OUT INVENTION

FIGS. 1 and 2 discloses the eraser assembly in its simplest embodiment attached to mechanical pencil 16. Mechanical pencil 16 can be generally characterized as having a number of distinct segments, the first is main cylindrical barrel 19, the second is frustum shaped segment 18, from the end of which extends pencil lead 17. Attached to the opposite end of cylindrical barrel 19 is pencil lead adjustment mechanism 20. A variety of different mechanical adjustment means 20 have been developed over the years and are in common use today. However, the actual mechanical assembly by which the pencil lead 17 is extended or retracted plays no part of this present invention.

Eraser sleeve 11 is formed to align in elemental parallel spaced relationship with both frustum shaped segment 18 and a portion of cylindrical barrel 19. Attachment band 15 is formed integral with eraser sleeve 11 to provide for circumferentially compressive engagement with cylindrical barrel 19 to hold eraser sleeve 11 in position.

Eraser sleeve 11 is hollow, and open at pencil lead end 11*a*. Elongated eraser plug 12 is inserted through opening 11*a* of sleeve 11. Eraser plug 12 is sized to provide for compressive frictional engagement between the eraser plug 12 and sleeve 11 to prevent eraser plug 12 from falling or dropping out of sleeve 11 when pencil 16 is held in an upright position.

Eraser plug 12 is attached to adjustment piston 13 by impalement on piston barb 13*a*. Extending up from adjustment piston 13 is push tab 14 which extends through elongated slot 9 formed integral with sleeve 11.

In use, a portion of eraser plug 12 extends out through sleeve opening 11a adjacent to pencil lead 17. Pencil 16 is held in the writer's hand in a position where lead 17 easily contacts the writing surface. To erase what has been written, the user merely axially rotates pencil 16 about its barrel axis to position the extended portion of eraser plug 12 over the writing to erase it.

BEST AVAILABLE COP

Adjustment of the position of eraser plug 12 is accomplished by sliding push tab 14 up or down within sleeve 11.

In a second embodiment, as shown in FIGS. 3, 4 and 5, the need for compressive frictional engagement between eraser plug 12 and sleeve 11 as shown in FIGS. 1 and 2 is eliminated thus providing for an eraser plug 12 which can be easily extended or retracted. In this second embodiment, eraser sleeve 21 is provided with notch tabs 22 formed integral therewith along elongated notched slot 23. Ratchet assembly 23 has adjustment piston 24 has formed integral therewith resilient cantilevered arm 26 and notch pawl 25 which ratchets from one notch to another along the length of elongated notched slot 23 when the user pushes tab 27 from one position to another within elongated notch slot 28. This ratchet assembly 23 provides a mechanically positive interlock between the ratchet piston assembly 23 and sleeve 21, thus eliminating the need for compressive frictional engagement between eraser plug 12 and sleeve 21. As before, eraser plug 12 is attached to adjustment piston 24 by impalement upon piston barb 24*a*.

In practice the eraser assembly 10 can be adapted to retrofit onto existing mechanical pencils, or wood pencils, or in the alternative, could be formed integral with either or both cylindrical barrel 19 or frustum segment 18 of a mechanical pencil.

While there is shown and described the present preferred embodiment of the invention, it is to be distinctly understood that this invention is not limited thereto but may be variously embodied to practice within the scope of the following claims.

I claim:

1. For use with a pencil having a generally cylindrical barrel segment and an attached frustum shaped segment and a pencil lead extending out from the point end of said frustum segment, a pencil eraser which comprises:

an elongated hollow eraser sleeve formed to align in elemental parallel spaced relationship with a portion of the cylindrical barrel of the pencil and to extend in elemental parallel spaced relationship along the frustum shaped segment of said pencil to a point adjacent to the point end of said frustum segment, said sleeve having an opening at the end adjacent to the point end of the frustum segment for receiving an elongated eraser plug, and further having an elongated slot running substantially the length of and along the longitudinal axis of said sleeve;

an elongated eraser plug slidably retained within said sleeve;

means for extending the eraser plug out through said sleeve opening slidably disposed with said sleeve; and means for attaching the sleeve to the pencil.

2. The pencil eraser of claim 1 wherein the means for extending the eraser plug out through said sleeve opening further comprises:

a piston slidably disposed within said hollow sleeve; and a push tab attached to said piston and extending out through said elongated slot.

3. The pencil eraser of claim 2 which further comprises means for attaching the eraser plug to said piston.

4. The pencil eraser of claim 3 wherein said means for attaching the eraser plug to the piston further comprises a barb attached to and extending normally out from the face of said piston for impalement within the eraser plug.

5. The pencil eraser of claim 1 which further comprises means for retracting said eraser plug into said hollow sleeve.

6. The pencil eraser of claim 5 wherein said means for both extending and retracting said eraser plug further comprises:

a piston slidably disposed within said hollow sleeve;

a push tab attached to said piston and extending out through said elongated slot; and a barb attached to and extending normally out from the face of said piston for impalement within the eraser plug.

7. The pencil eraser of claim 1 wherein said hollow sleeve further comprises:

a plurality of juxtaposed notch tabs formed along the longitudinal sides of said elongated slot for forming an elongated notched slot;

a piston slidably disposed within said hollow sleeve;

a resilient cantilever arm attached to said piston and aligned with the longitudinal axis of said elongated slot; and a pawl attached to and extending perpendicularly from the resilient cantilevered arm for resilient, frictional engagement with the notches of said elongated slot.

8. The pencil eraser of claim 7 which further comprises means for attaching the eraser plug to said piston.

9. The pencil eraser of claim 8 wherein said means for attaching the eraser plug to the piston further comprises a barb attached to and extending normally out from the face of said piston for impalement within the eraser plug.

10. The pencil eraser of claim 7 which further comprises means for retracting said eraser plug into said hollow sleeve.

* * * * *